United States Patent [19]

Dranselka

[11] Patent Number: 4,739,984

[45] Date of Patent: Apr. 26, 1988

[54] PORTABLE EXERCISE DEVICE FOR UPPER AND LOWER BODY

[76] Inventor: Marvin A. Dranselka, R.R. #1, Wayne, Nebr. 68787

[21] Appl. No.: 906,712

[22] Filed: Sep. 12, 1986

[51] Int. Cl.[4] ..... A63B 21/00; A63B 21/22

[52] U.S. Cl. ..... 272/73; 272/132; 272/900

[58] Field of Search ..... 272/73, 900, 132, 93; 128/25 R

[56] References Cited

U.S. PATENT DOCUMENTS

| | | | |
|---|---|---|---|
| 3,259,385 | 7/1966 | Boren | 272/73 |
| 3,910,571 | 10/1975 | Stenn | 272/73 |
| 4,262,902 | 4/1981 | Dranseeka | 272/132 |
| 4,390,177 | 6/1983 | Biran et al. | 272/73 |
| 4,478,213 | 10/1984 | Redding | 128/25 R |

FOREIGN PATENT DOCUMENTS

| | | | |
|---|---|---|---|
| 2315291 | 1/1977 | France | 272/109 |
| 287385 | 2/1965 | Netherlands | 272/73 |

*Primary Examiner*—Richard J. Apley
*Assistant Examiner*—S. R. Crow
*Attorney, Agent, or Firm*—Henderson & Sturm

[57] ABSTRACT

A portable device for exercising both the upper and the lower body portions, which portable device comprises a pedal assembly including a housing, a shaft rotatably disposed through said housing, and a pedal means attached to the shaft for rotating the shaft; U-shaped frame means having a base and a pair of parallel legs each secured at one end to one end of the base, with the other end of each leg free, the pedal assembly secured adjacent one end of the base; first bracket means connected to one leg free end for attachment to an object such as a chair upon which a person may be seated, the first bracket means rotatable about the chair attachment, whereby the frame is movable arcuately about the chair to move the pedal assembly from a first lower position for engagement by the feet of the person seated on the chair to a second higher position for engagement by the hands of the person.

7 Claims, 2 Drawing Sheets

PORTABLE EXERCISE DEVICE FOR UPPER AND LOWER BODY

TECHNICAL FIELD

The present invention relates generally to exercising devices, and more particularly to a portable exercise device that can be used for upper and lower body exercise in conjunction with conventional chairs, wheelchairs and the like.

BACKGROUND ART

This invention relates to portable pedalling type exercise devices of a type to be used in conjunction with conventional chairs, bed frames, wheelchairs and the like for exercising both the upper and lower body. This invention relates more particularly to pedal exercise devices operated either by the feet of a person, or by the hands thereof with kinesitherapeutic applications for convalescing, elderly and/or handicapped persons whose treatment requires a less expensive portable and easily-stowable device. This portable exerciser is ideal for a visiting nurse or in-the-home therapy program, and can be used for regular home therapy or exercise programs.

Several techniques have been employed in the past to provide a portable exercise device for exercising the lower body, as exemplified in U.S. Pat. Nos. 3,259,385; 4,262,902; and 4,390,177. None of these patents, however, and no other structure known, teach or provide an exerciser for use with a chair or the like for exercising both the upper and lower body portions in one sitting and with one pair of pedals, and further without rearranging, adding to or disassembling certain portions of the exercise structure.

DISCLOSURE OF THE INVENTION

The present invention relates to a portable device for exercising both the upper and the lower body portions, which portable device comprises a pedal assembly including a housing, a shaft rotatably disposed through said housing, and a pedal means attached to the shaft for rotating the shaft; U-shaped frame means having a base and a pair of parallel legs each secured at one end to one end of the base, with the other end of each leg free, the pedal assembly secured adjacent one end of the base; first bracket means connected to one leg free end for attachment to an object such as a chair upon which a person may be seated, the first bracket means rotatable about the chair attachment, whereby the frame is movable arcuately about the chair to move the pedal assembly from a first lower position for engagement by the feet of the person seated on the chair to a second higher position for engagement by the hands of the person.

Another feature of the present invention is that the first bracket means includes a T-shaped unit, the outer ends of which can telescopically engage portions of the chair, for example, and provide a rotatable connection therewith, whereby the portable exercising device is movable arcuately about the chair from a floor engaging position to a raised, near-vertical position.

It is an object of this invention to provide an improved portable exercise device which can readily and easily be used by a person seated in a wheelchair, for example, to exercise the lower part of his/her body by rotating a pedal assembly with the feet; whereby the person may then lift up the pedal assembly by moving it arcuately about the chair to a near-vertical resting position where the device is operable by using the hands to rotate the pedals, thus exercising the upper part of the body in this position of the device.

It is another object of this invention to provide a portable exercise device for upper and lower body exercise, which exerciser will fit a variety of chairs and wheelchairs which gives the individual the confidence to use the unit along with the comfort of being in their familiar seating arrangement.

A further object of this invention is to provide an exercise device that can be used for upper and lower body exercise, which device is lightweight, compact, easy to transport and store. The instant invention has the advantage further of utilizing a conventional chair in lieu of expensive and space consuming portions of conventional pedal-type exercise devices with bicycle seats, handlebars, and the like.

Another object of this invention is to provide an exerciser that can be used for both the upper and lower body exercise, which device enables both upper and lower body exercise to occur while a person is comfortably seated; such that a person in a convalescent home or the like does not need to climb onto a conventional bicycle-type exerciser, or climb into and out of a rowing machine-type exerciser for accomplishing exercise of both the upper and lower body.

Further features, objects and advantages of this invention will be apparent from a consideration of the following drawings and description which incorporates said drawings.

BEST MODE FOR CARRYING OUT THE INVENTION

Figure 1:
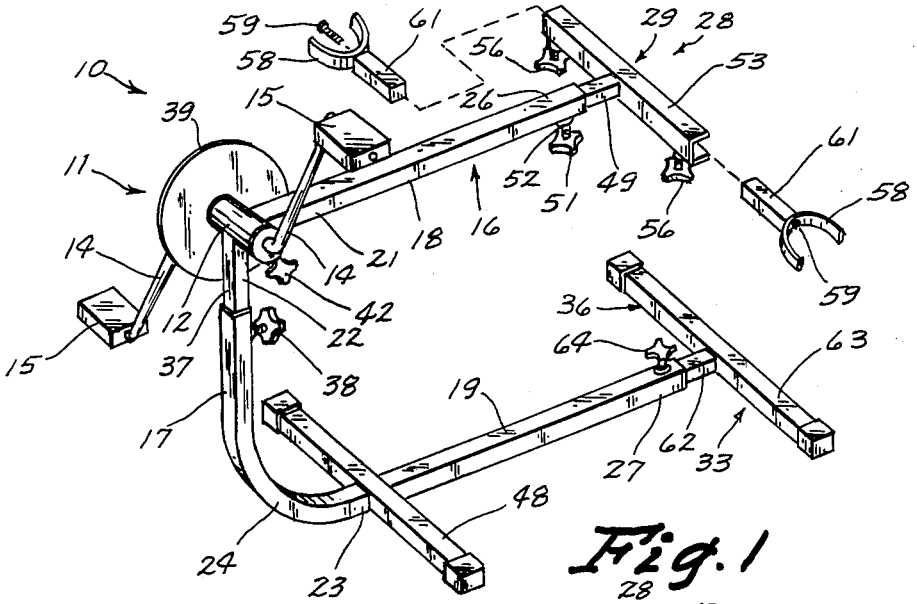
FIG. 1 is a perspective view of an embodiment of the present invention.

Referring now to the drawings, wherein like reference numerals designate identical or corresponding parts throughout the several views, the portable exercise device for upper and lower body is designated generally by the numeral 10 in FIG. 1. The portable exercise device (10) comprises a conventional cycle pedal assembly (11) which includes a housing (12), a shaft (13) rotatably disposed through the housing (12) and a pedal unit (14) including pedals (15). The device (10) includes further U-shaped frame means (16) having a base (17) and a pair of parallel legs (18 and 19). The normally upper leg (18) is secured at one end (21) to the pedal assembly housing (12) adjacent one end (22) of the base, and the other, normally lower leg (19) is secured at one end (23) to the other end (24) of the base (17). The respective legs (18 and 19) have free ends (26 and 27), respectively, thereof at their opposite ends away from the base (17).

Figure 4:
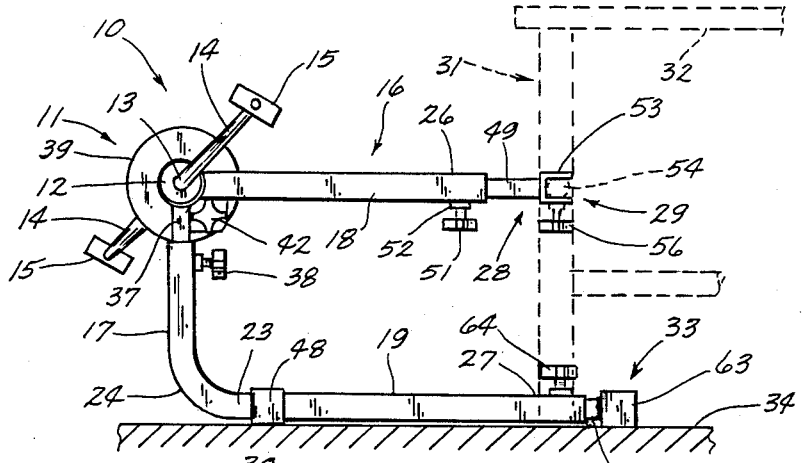
FIG. 4 is a side elevational view of the invention as it is placed in connecting relationship with a chair, the latter shown in dotted lines.
Figure 5:
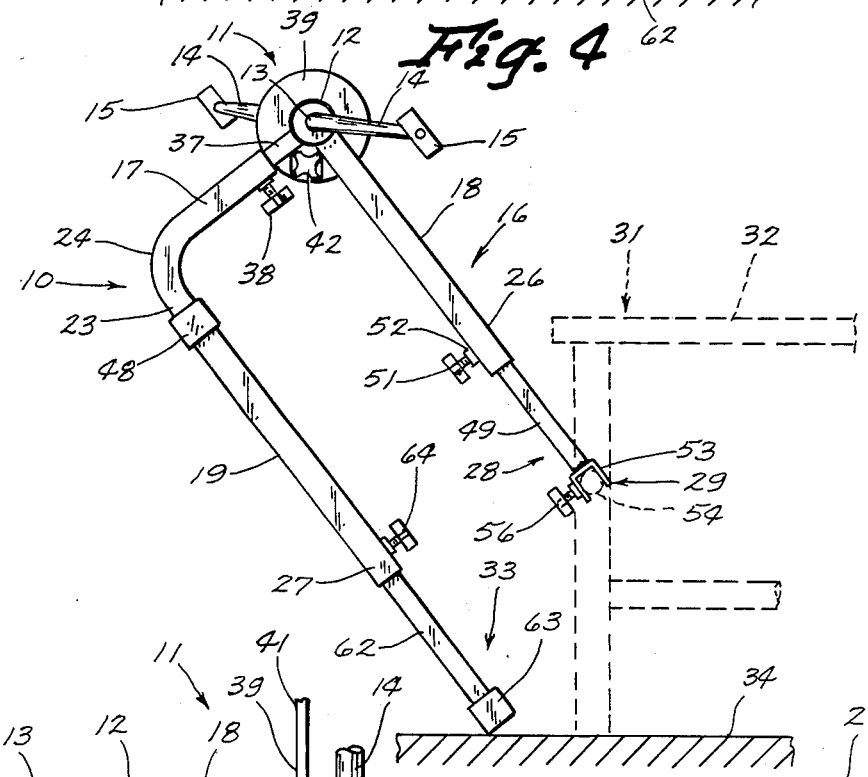
FIG. 5 shows the embodiment of the invention in FIG. 4, with FIG. 5 showing the exercise device moved arcuately toward a vertical position relative to the supporting chair and floor.

Additionally, the portable exercise device (10) comprises a first bracket unit (28) connected to the upper leg (18) free end (26) by an attaching unit (29), which unit (29) is rotatably attached to a chair (31), for example, as best illustrated in FIG. 4, which chair has a seat (32) for receipt of a person such that his/her legs extend toward the pedal assembly (11) in the position of the portable device (10) as it is shown in FIG. 4. A second bracket unit (33) is secured to the free end (27) of the lower leg (19) such that both the lower leg (19) and the second bracket unit (33) rest upon a floor (34) (FIG. 4) for supporting the chair (31), this being in a first position. In a second position, the portable device (10) is arcuately movable about the first bracket attaching unit (29) and the chair (31) to a near-vertical position as best illustrated in FIG. 5, and wherein the outer end (36) of the second bracket unit (33) rests upon the floor (34), and is placed in a position such as to receive the feet of the person resting on the seat (32) of the chair (31).

Figure 2:
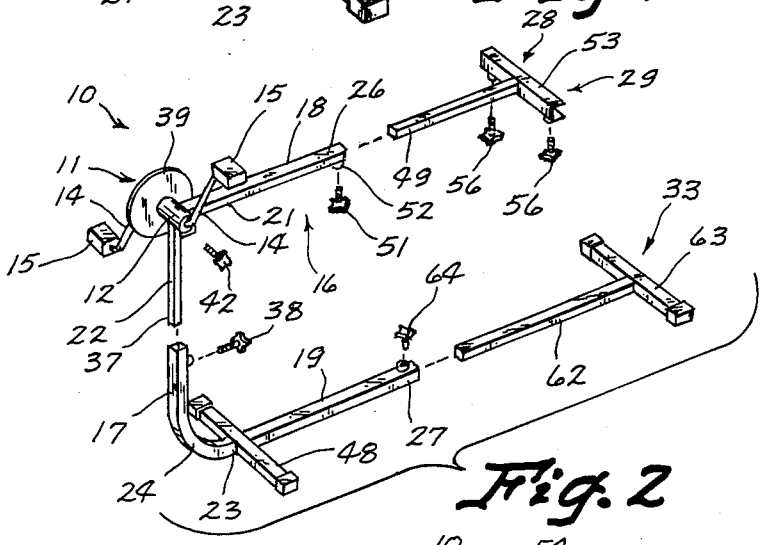
FIG. 2 is a reduced perspective view of the embodiment of FIG. 1, with certain parts shown in exploded view to illustrate the telescopic capabilities thereof.
Figure 6:
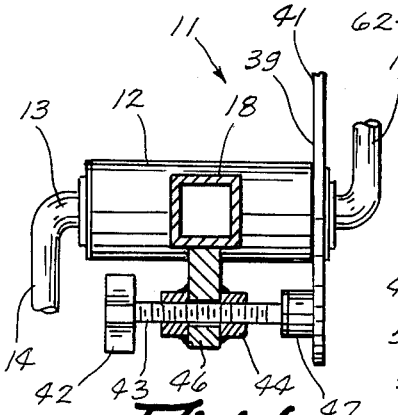
FIG. 6 is an enlarged detail view as taken along the sectional lines 6—6 in FIG. 3.
Figure 7:
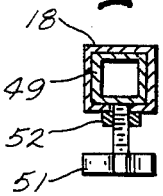
FIG. 7 is an enlarged detail view as taken along the sectional lines 7—7 in FIG. 3.

More particularly, the pedal assembly (11) includes a telescoping leg (37) (FIG. 2) which functions as one end (22) of the base (17) and slidably engages the base (17). A conventional clamp (38) is threaded through the base to engage the leg (37) for fixing the telescoping leg (37) in an adjusted position. A circular plate (39) (FIG. 1) is attached to the pedal assembly shaft (13) (FIG. 6) for rotation therewith, the periphery (41) of the plate (39) being exposed, and with a clamp (42) having a threaded shaft (43) threded through a housing (44) which is welded to a bar (46) depending from a welded engagement with the upper leg (18), and with a friction pad (47) affixed to the end of the shaft (43) for frictional engagement with the plate (39). By this arrangement, rotation of the clamp (42) by the user varies the pressure of the pad (47) against the rotatable plate (39), thereby applying a variable drag to the plate (39) for varying the force required to turn the shaft (13) via the pedals (15).

A stabilizing bar (48) (FIGS. 1 and 2), is secured transversely of the lower leg (19) adjacent its end (23) for the purpose of providing lateral stability to the portable exercise device (10) when it is placed in its first position as best illustrated in FIG. 1. The stabilizing bar (48) normally rests upon a floor or other relatively flat surface.

The first bracket unit (28) comprises an elongated tube (49) (FIG. 2) having a slightly smaller cross section such as to be telescopically fitted into the upper leg (18). The position of the tube (49) within the leg (18) is determined by locking the tube (49) in place due to a clamp (51) threaded through a nut (52) which is affixed to the leg (18), such that the clamp (51) may threadably engage the tube (49), thus holding it in place. By merely releasing the clamp (51), the tube (49) may be re-adjustably located within the leg (19).

Figure 8:
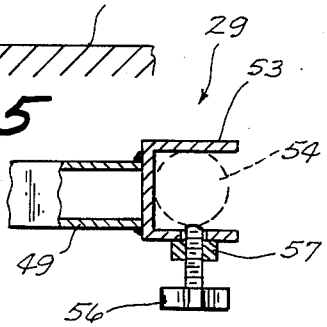
FIG. 8 is an enlarged detail view as taken along the sectional lines 8—8 in FIG. 3.

Referring to FIG. 8, the attaching unit (29) is illustrated, comprising an elongated U-shaped element (53) secured at its mid-point to the outer end of the tube (49), and extended laterally relative thereto. The open portion of the element (53) faces a normally horizontally disposed brace (54) of the chair (31), for example, such as to embrace same. The element (53) may be adjustably secured to the brace (54) by means of a conventional clamp (56) threaded through a nut (57) which is affixed to the element (53). Again, by this arrangement the user can adjust the clamping engagement of the attaching unit (29) to the chair (31) upon which the user is seated, thereby enabling the exercise device (10) to be moved arcuately about the chair.

Figure 3:
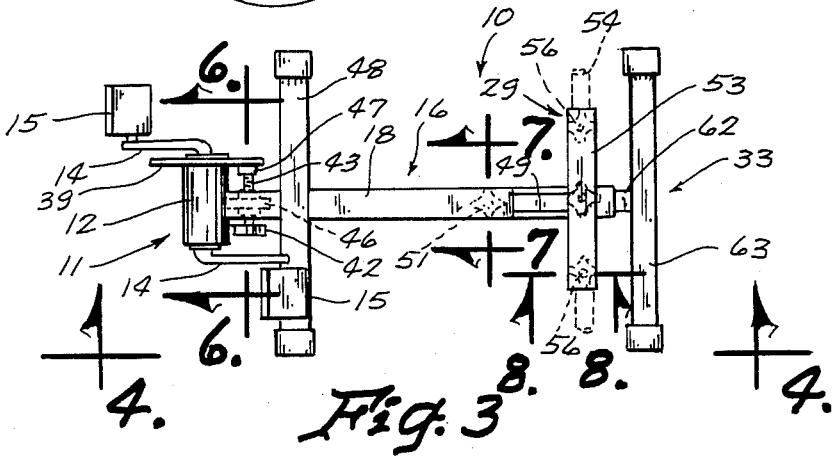
FIG. 3 is a top plan view of the invention, with certain parts shown in dotted lines for clarity of illustration.

For stabilizing purposes, a pair of clamps (56) may be provided in relation to the element (53) as best illustrated in FIGS. 1 and 3.

In instances where a horizontally disposed chair brace (54) is not provided, such as in the case of a wheelchair where only vertically disposed posts (not shown) are provided; to mount the attaching unit (29) on such vertically disposed posts, a pair of cresent-shaped end pieces (58) (FIG. 1) are provided, each end piece (58) being rotatably mounted about a normally horizontal axis by means of a pivot pin (59) to the outer end of a shaft (61). Each shaft (61) is insertable into the outer end of the U-shaped element (53), and may be telescopically oriented relative thereto and clamped in place by means of the clamp (56) found at each end of the element (53). By this arrangement, with each crescent-shaped end piece (58) engaged with a vertical post of a wheelchair (not shown), again the entire portable exercise device (10) may be arcuately moved about the wheelchair to a position best illustrated in FIG. 5.

The device (10) is completed by the second bracket unit (33) (FIGS. 1 and 2) which unit (33) comprises an elongated shaft (62) with a stabilizing bar (63) secured to the outer end thereof in a T-shaped manner. The shaft (62) can be telescopically inserted into the lower leg (19) and oriented realtive thereto by means of another clamp (64) threadably mounted on the leg (19) for insertion therethrough and for engagement with the shaft (62).

For use of the portable exercise device (10) by the feet of a person seated for example, on the seat (32) of a conventional chair (31), it will be seen that the first bracket unit (28) and the attaching unit (29) are manipulated to be rotatably engaged with the horizontally disposed chair brace (54); with the lower leg (19) of the device (10) resting upon the floor, and with the device (10) stabilized on the floor (34) by means of both stabilizing bars (48 and 63). In relation, the person seated on the chair (31) can easily and readily engage the pedals (15) by his/her feet such as to effect rotation of the pedal assembly (11) about the shaft (13). Again, by manipulation of the clamp (42), the amount of drag placed upon the pedal assembly (11) for effecting rotation thereof can be varied by the person using the device (10).

Should it be desirable to use the exercise device by the upper body, i.e., by rotation of the pedals (15) by the hands of the person placed thereon; it will be noted that both the tube (49) (FIG. 5) of the first bracket unit (28) is lengthened, and the shaft (62) of the second bracket unit (33) is also lengthened, relative to both the upper and lower legs (18 and 19), respectively. In this arcuately raised position of the device about the chair brace (54), the extended length of the shaft (62) is such that the stabilizing bar (63) is resting upon the floor (34).

When the pedal assembly (11) is operated by the placement of the person's hands upon the pedal (15), the exercise device (10) is further stabilized by the person placing his/her feet upon the stabilizing bar (63) and the floor (34). Although not necessary to operation of the device (10), by so placing the person's feet upon the bar

(63) and the floor (34), the lower body of the person using the device (10) is placed in a comfortable position for exercise of the upper body, and the stability of the device (10) relative to the attaching unit, whether chair (31) or wheelchair (not shown), is enhanced.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A portable device for exercising the upper and lower body, the device comprising:

a pedal assembly including a housing, a shaft rotatably disposed through said housing, and a pedal means attached to said shaft for rotating said shaft;

U-shaped frame means having a base and a pair of parallel legs having opposite ends, each leg secured at one end to one end of said base, said pedal assembly secured adjacent one end of said base;

first means connected to an opposite end of one leg for attachment to an object upon which a person may be seated for using said portable device, said first means rotatable about the object attachment, whereby said frame is movable arcuately about the object to move said pedal assembly from a first position for engagement of said pedal means by the feet of a person seated on the object to a second position for engagement of said pedal means by the hands of a person seated on the object; and second means connected to an opposite end of the other leg and movable with said frame from a first position disposed beneath the object to a second position disposed forwardly of the object and engageable by the feet of a person seated on the object, and with said other leg moved from a horizontal position in said first position to an upright position in said second position of said second means.

2. The invention of claim 1 and further wherein said first means includes a member forming a T-shape with said one leg, said member adapted to grasp the object in a manner to provide a rotatable connection therewith.

3. The invention of claim 1 and further wherein said second means includes an element secured thereto and extended outwardly from both sides thereof.

4. The invention of claim 2 and further wherein said second means includes an element secured thereto and extended outwardly from both sides thereof.

5. The invention of claim 2 and further wherein an element is rotatably connected at each outer end of said member for engaging a normally upright portion of the object.

6. The invention of claim 5 and further wherein the effective length of said member is adjustable for grasping the object.

7. The invention of claim 1 and further wherein a plate is attached to said shaft for rotation therewith, the periphery of said plate exposed beyond said housing, and means attached to the frame for engaging said plate and applying a variable drag thereto for varying the force required to turn said shaft.

* * * * *